United States Patent [19]

Oppenländer et al.

[11] Patent Number: 4,957,327

[45] Date of Patent: Sep. 18, 1990

[54] METHODS OF TRANSLATING A FACE SUPPORT

[75] Inventors: Harry Oppenländer, Wetter; Heiko Druzela, Recklinghausen, both of Fed. Rep. of Germany

[73] Assignee: Klöckner-Becorit GmbH, Fed. Rep. of Germany

[21] Appl. No.: 381,840

[22] Filed: Jul. 19, 1989

[30] Foreign Application Priority Data

Jul. 20, 1988 [DE] Fed. Rep. of Germany ..... 3824522

[51] Int. Cl.[5] ..... E21D 23/14

[52] U.S. Cl. ..... 299/11; 405/300; 405/302

[58] Field of Search ..... 299/11, 33; 495/302, 495/299, 300; 91/170 MD

[56] References Cited

U.S. PATENT DOCUMENTS

| | | | |
|---|---|---|---|
| 2,803,444 | 8/1957 | Potts | 299/33 |
| 4,073,151 | 2/1978 | Harmsma | 405/291 |
| 4,892,446 | 1/1990 | Rachel | 299/11 X |

FOREIGN PATENT DOCUMENTS

| | | | |
|---|---|---|---|
| 2055113 | 5/1972 | Fed. Rep. of Germany | 405/302 |
| 2229154 | 8/1974 | Fed. Rep. of Germany . | |
| 2212686 | 7/1978 | Fed. Rep. of Germany . | |
| 2700798 | 9/1980 | Fed. Rep. of Germany . | |
| 3110854 | 1/1983 | Fed. Rep. of Germany . | |
| 3111875 | 8/1987 | Fed. Rep. of Germany . | |
| 1079172 | 8/1967 | United Kingdom | 405/302 |

OTHER PUBLICATIONS

Jacobi: Automatisierung des Strebausbaus zur besseren Pflege des Hangenden, (1965), Gluckauf, p. 862.

*Primary Examiner*—Ramon S. Britts
*Assistant Examiner*—David J. Bagnell
*Attorney, Agent, or Firm*—Watson, Cole, Grindle & Watson

[57] ABSTRACT

Methods are provided for translating a face support comprising a plurality of support units arranged side-by-side at an initial position. In the first embodiment, a first pair of alternately positioned support units are moved a predetermined distance from the initial position. Next, a second pair of alternately positioned support units are moved the predetermined distance. One of the support units of the second pair is positioned between the first pair. These moving steps are repeated until the entire plurality of support units is moved the desired distance. In the second embodiment, the first moving step is duplicated. Then, a single support unit located between the first pair is moved the predetermined distance. These two moving steps are repeated until all of the support units are moved.

4 Claims, 2 Drawing Sheets

METHODS OF TRANSLATING A FACE SUPPORT

BACKGROUND

1. Technical Field of the Invention

The present invention relates generally to mine tunnel supports and more specifically to methods of moving a face support comprising a plurality of powered support units.

2. Description of the Related Art

Face supports are well known to support long wall coal cutters during mining operations. The conventional manner for moving a face support comprises moving each of the individual powered support units independently and sequentially. For example, initially the first powered support unit is moved and subsequently the second, the third and so forth are moved until the end of the face support. The speed that is obtained in moving up the face support is thus less than the speed of the long wall coal cutter so that the long wall coal cutter must wait for the support. Thus, the long wall coal cutter cannot be employed in its full capacity for cutting out the coal. Such conventional systems are shown in German Pat. Nos. 22 12 686, 22 29 154, 31 10 854 and 31 11 875 and German Published Patent Nos. 27 00 798.

Accordingly, it is an object of the present invention to develop a method for moving a face support of the aforementioned type in such a manner that the long wall coal cutter can unfold its full capacity.

It is another object of the present invention to accomplish this movement in a safe manner.

It is a further object of the present invention to accomplish this movement while retaining the supporting forces of the support.

Other objects and advantages will become apparent in the drawings and specification which follow.

SUMMARY OF THE INVENTION

The foregoing and additional objects are obtained by methods of translating a face support comprising a plurality of support units arranged side-by-side at an initial position. In the first embodiment, a first pair of alternately positioned support units are moved a predetermined distance from the initial position. Next, a second pair of alternately Positioned support units are moved to predetermined distance. One of the support units of the second pair is positioned between the first pair. These moving steps are repeated until the entire plurality of support units is moved the desired distance.

In the second embodiment, the first moving step is duplicated. Then, a single support unit located between the first pair is moved the predetermined distance. These two moving steps are repeated until all of the support units are moved.

DETAILED DESCRIPTION OF THE PREFERRED EMBODIMENTS

Figure 1:
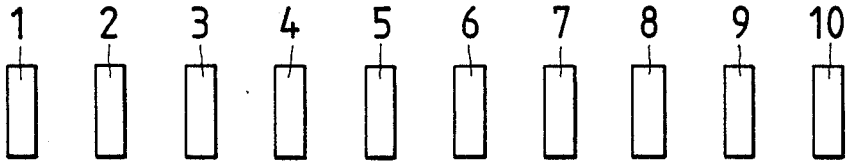
FIG. 1 shows a portion of the powered support units forming the face support at an initial position.

Referring to FIGS. 1, a face support is seen to comprise a plurality of powered support units respectively designated by reference numerals 1, 2, 3, 4, 5, 6, 7, 8, 9 and 10. In practice, the face support unit can comprise two hundred support units. In FIG. 1, the support units are initially arranged side-by-side at an initial position.

Figure 2:
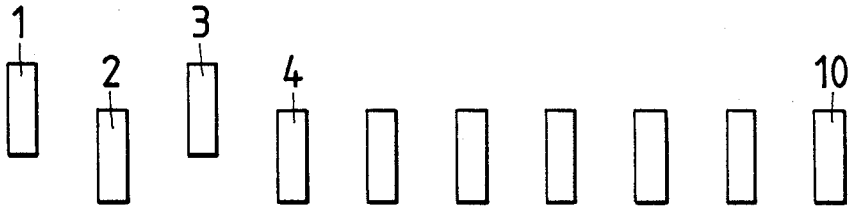
FIGS. 2–5 the various movements of the support units according to a first preferred embodiment of the present invention.
Figure 3:
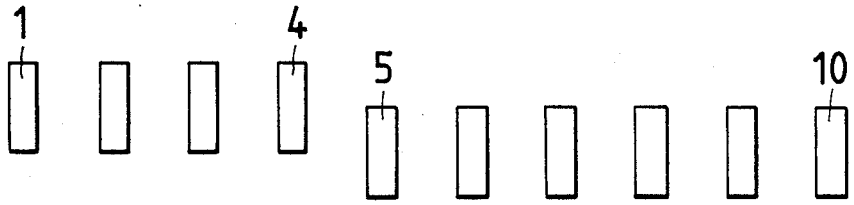

FIGS. 2–5 show a first preferred embodiment of the present invention. Referring now to FIG. 2, a first pair of alternately positioned support units, i.e., support units 1 and 3, are moved a predetermined distance from the initial position. Referring now to FIG. 3, a second pair of alternately positioned support units, i.e., support units 2 and 4, are then moved the predetermined distance so that this second pair is now side-by-side with the first pair. This second pair is adjacent to the first pair, i.e., support unit 2 of the second pair is positioned between support units 1 and 3 of the first pair.

Figure 4:
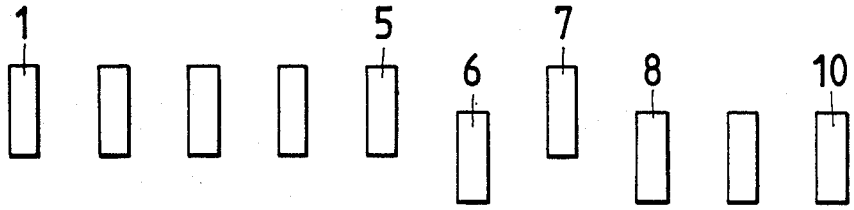
Figure 5:
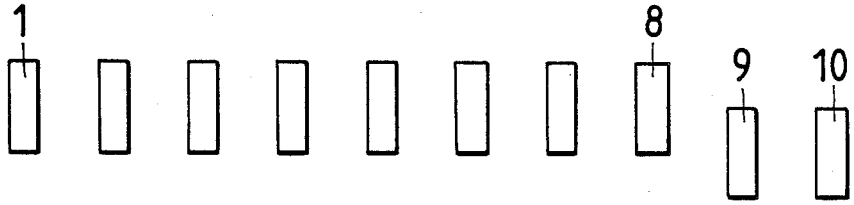

Next, the preceding moving steps are repeated. Specifically, alternately positioned support units 5 and 7 are moved the predetermined distance, as shown in FIG. 4. Alternately positioned units 6 and 8 are then moved the predetermined distance, as shown in FIG. 5. This moving continues until the entire plurality of support units is moved the predetermined distance.

The foregoing method accordingly moves adjacent alternately positioned pairs of support units sequentially. This method thus moves the entire plurality of support units in approximately half the time required by the conventional method of moving.

Of course, the total number of support units may be such that a complete pair of support units may not remain to be moved. In this case, the remaining support units may be individually moved the predetermined distance to complete the moving process.

Figure 6:
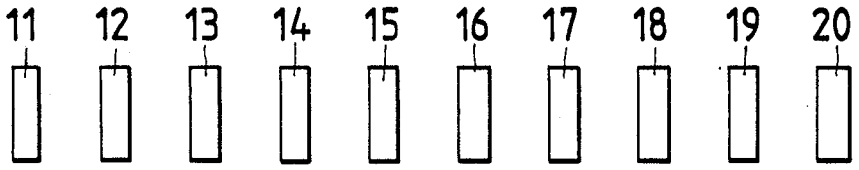
FIG. 6 shows a portion of the powered support units forming the face support at an initial position.

Similar to FIG. 1, FIG. 6 shows a face support comprising a plurality of support units designated respectively by reference numerals 11, 12, 13, 14, 15, 16, 17, 18, 19 and 20.

Figure 7:
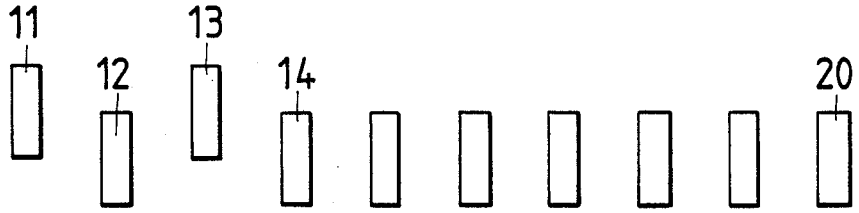
FIGS. 7–10 show the various movements of the support units according to a second preferred embodiment of the present invention.
Figure 8:
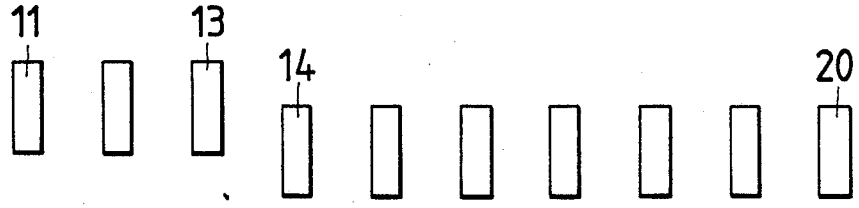

FIGS. 7–10 show a second preferred embodiment of the present invention. As shown in FIG. 7, a first pair of alternately positioned support units, i.e., support units 11 and 13, are moved a predetermined distance from the initial position. Next, a single support unit, i.e., support unit 12, is moved the predetermined distance. This single support unit 12 is located between the pair of alternately positioned support units 11 and 13.

Figure 9:
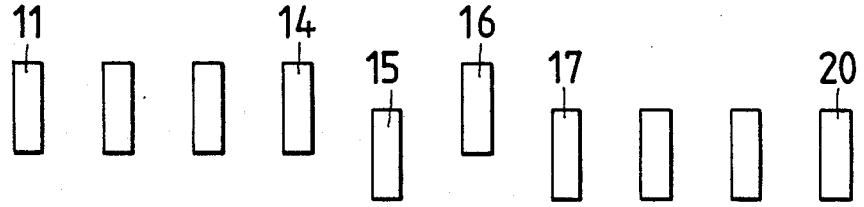
Figure 10:
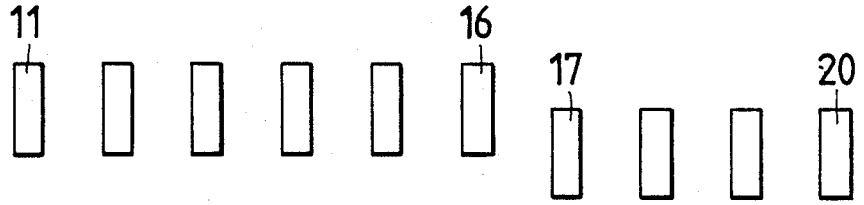

These moving steps are repeated. Specifically, alternately positioned support units 14 and 16 are moved the predetermined distance, as shown in FIG. 9. Next, single unit 15 is moved, as shown in FIG. 10. This repetition continues until the entire plurality of support units is moved.

The foregoing method first moves a pair of alternately positioned support units and them moves the support unit positioned therebetween. Accordingly, this second embodiment may move the entire plurality of support units in approximately two thirds of the time required by the conventional method.

In both preferred embodiments, the powered support units can be moved by any conventional method such as manually from an adjacently located powered unit. Preferably, the support units are moved centrally from a control stand. In the second embodiment, the single support unit would be moved automatically once the pair of support units had been moved.

Preferably, the support units are moved along the longitudinal axis of the face support in a desired direction. If the support units are moved manually, the operator will of course stand on the side of the face support opposite the desired direction of the movement.

When moving the support units, the units are preferably depressurized so that they no longer firmly abut the roof and floor of the tunnel. After the move, pressure is supplied so that the support units properly support the tunnel.

We claim:

1. A method of translating a face support comprising a plurality of support units initially arranged side-by-side at an initial position, the method comprising:

moving a first pair of alternately positioned support units a predetermined distance from the initial position;

moving a second pair of alternately positioned support units the predetermined distance from the initial position, one of said units of said second pair being positioned between said first pair; and repeating the preceding moving steps until the entire plurality of support units is moved the predetermined distance from the initial position.

2. The method of claim 1, wherein said moving steps are directed along a longitudinal axis of the face support.

3. A method of translating a face support comprising a plurality of support units initially arranged side-by-side at an initial position, the method comprising:

moving a pair of alternately positioned support units a predetermined distance from the initial position;

moving a single support unit located between said Pair of alternately positioned support units the predetermined distance from the initial position; and repeating the preceding moving steps until the entire plurality of support units is moved the predetermined distance from the initial position.

4. The method of claim 3, wherein said moving steps are directed along a longitudinal axis of the face support.

* * * * *